US005589921A

United States Patent [19]

Markies et al.

[11] Patent Number: 5,589,921

[45] Date of Patent: Dec. 31, 1996

[54] INTERMEDIATE TRANSFER MEMBER HAVING A MATERIAL WHICH BREAKS DOWN IMPURITIES

[75] Inventors: Peter R. Markies, Grubbenvorst; Mark Miedema, Em Velden, both of Netherlands

[73] Assignee: Oce-Nederland, B.V., Venlo, Netherlands

[21] Appl. No.: 402,051

[22] Filed: Mar. 10, 1995

[30] Foreign Application Priority Data

Mar. 11, 1994 [NL] Netherlands ..... 9400382

[51] Int. Cl.[6] ..... G03G 13/16

[52] U.S. Cl. ..... 399/297; 430/126

[58] Field of Search ..... 355/271, 272, 355/273, 277, 279, 296, 297; 430/125, 126

[56] References Cited

U.S. PATENT DOCUMENTS

| | | | |
|---|---|---|---|
| 4,453,820 | 6/1984 | Suzuki | 355/279 |
| 4,607,947 | 8/1986 | Ensing et al. | 355/283 |
| 5,361,126 | 11/1994 | Loonen et al. | 355/279 |
| 5,521,687 | 5/1996 | Bors et al. | 355/271 |

FOREIGN PATENT DOCUMENTS

| | | |
|---|---|---|
| 0146980 | 7/1985 | European Pat. Off. . |
| 0581365 | 2/1994 | European Pat. Off. . |
| 1279687 | 6/1972 | United Kingdom . |

OTHER PUBLICATIONS

European Search Report, EP/95 20 0447.

*Primary Examiner*—Nestor R. Ramirez
*Attorney, Agent, or Firm*—Birch, Stewart, Kolasch & Birch, LLP

[57] ABSTRACT

A device and method associated therewith for transferring a toner image from an image-forming medium to a receiving material comprising: an image-forming medium, an endless movable intermediate medium provided with a top layer in contact with the image-forming medium in a first transfer zone, a heater for heating the toner image on the top layer of the intermediate medium, a biased belt which in a second transfer zone can be brought into contact with the intermediate medium, a transport device for transporting the receiving material through the second transfer zone, and a material for removing from the top layer of the intermediate medium impurities transferred thereto, by contacting the impurities with a material metal compound which breaks down the impurities.

30 Claims, 2 Drawing Sheets

INTERMEDIATE TRANSFER MEMBER HAVING A MATERIAL WHICH BREAKS DOWN IMPURITIES

BACKGROUND OF THE INVENTION

1. Field of the Invention

The invention relates to an electrostatic imaging system and, more specifically, to an apparatus and associated method for transferring a toner image from an image-forming medium to a receiving material and removing residual impurities from the imaging system so as not to contaminate the image-forming medium.

2. Discussion of Related Art

U.S. Pat. No. 4,607,947 describes a contact fixing device in which a toner image is transferred from an image-forming medium to a heatable intermediate medium. In a fixing zone, in which the intermediate medium is in contact with a biasing means, the toner image is then transferred and simultaneously fixed on a receiving material being transported through the fixing zone. However, impurities may be transferred from the receiving material to the intermediate medium. Toner material residues may also remain as an impurity on the intermediate medium because of incomplete transfer of the toner image to the receiving material. If impurities of this kind are left on the intermediate medium, they may be subsequently transferred to the image-forming medium in the first transfer zone. This causes disturbance to the image-formation and hence, ultimately, image errors in the copy on the receiving material.

Various cleaning means have been proposed to remove these impurities from the intermediate medium before reaching the first transfer zone. For example, U.S. Pat. No. 4,607,947 discloses a cleaning means having a cleaning surface to which toner adheres better than to the intermediate medium. A cleaning means of this kind operates satisfactorily for removing high-melting impurities such as toner residues. This cleaning means can also be used to remove paper dust from the intermediate medium. In practice, however, it has been found that low-melting impurities from receiving materials, such as wax-like compounds, plasticizers, anti-foaming agents, plastic fillers occurring in receiving papers, and dust particles from plastic receiving materials, and the like, are not removed or only partly removed from the intermediate medium with known cleaning means. After being deposited on the intermediate medium in the second transfer zone these impurities can also be transferred in the first transfer zone to the image-forming medium, resulting in disturbed image-formation and hence, ultimately, image defects in the copy on the receiving material. This necessitates regular and premature replacement of the intermediate medium and image-forming medium, involving high maintenance costs and equipment downtime. For example, it has been found that the increasingly used "alkaline" receiving papers based, inter alia, on cellulose, chalk and sizing agents, such as alkyl ketene dimers, are an appreciable source of such impurities. Such receiving papers are used today because of the lower costs and better durability in comparison with the "acidic" receiving papers based, inter alia, on cellulose, clay and modified or unmodified resins. It has now been found that where such receiving papers are used reaction products of these binders are deposited from these papers in the top layer of the intermediate medium. These reaction products are then transferred to the image-forming medium resulting in image disturbance.

To remove these reaction products from the top layer, U.S. Pat. No. 5,361,126, the entire content of which is herein incorporated by reference, proposes to remove the impurities via the rear of the top layer to a rubber intermediate or underlayer. An impurity-absorbing material, such as carbon black, is mixed in this intermediate layer. It is also proposed to bring transport rollers into contact with the intermediate or underlayer on the side thereof remote from the top layer, so that further transport of the impurities from the top layer can take place. U.S. application Ser. No. 093,657, filed Jul. 20, 1993, now U.S. Pat. No. 5,521,687, the entire contents of which is herein incorporated by reference, proposes using a cleaning means which between the second transfer zone and the first transfer zone can be brought into contact with the top layer of the intermediate medium, the outside of the cleaning means being provided with an impurity-absorbing material. In the devices described in the above patent documents, the amount of impurities in the top layer is reduced, but a problem still remains in that after some time the intermediate layer or underlayer becomes saturated with impurity-absorbing material and the cleaning means becomes saturated with the impurities originating from the receiving materials, thus necessitating premature replacement of intermediate medium and/or cleaning means.

SUMMARY OF THE INVENTION

Therefore, it is an object of the present invention to provide an apparatus for transferring a toner image from an image-forming medium to a receiving material which will overcome the above-noted disadvantages.

A further object of the present invention is to provide a cleaning system for an image transfer device in the transfer of a toner image from an image forming medium to a receiving material.

Still, a further object of the present invention is to provide a toner image transfer system which substantially eliminates impurity deposits which result in the disturbance of image formation.

The foregoing objects and others are accomplished in accordance with the present invention, generally speaking, by providing a device comprising an image forming medium, means for developing a toner image on the image forming medium, intermediate medium movable in a transport direction having a support, the intermediate medium being provided with a top layer secured via its rear surface to the support, the intermediate medium being in contact with the image-forming medium in a first transfer zone, a heating means for heating the toner image on the top layer of the intermediate medium, a biasing means which in a second transfer zone can be brought into contact with the intermediate medium, transport means for transporting the receiving material through a second transfer zone and means are provided for breaking down impurities transferred by receiving materials to the top layer of the intermediate medium. As a result, the amount of impurities in the top layer is reduced for a long period, so that the life of the intermediate medium and the image-forming medium, i.e. the time during which the medium can be used without image degradation occurring, is greatly increased.

DETAILED DISCUSSION OF THE INVENTION

The means for breaking down impurities on the intermediate medium comprises a material which can be brought into contact with the impurities so as to break down the impurities, this material which breaks down the impurities containing a transition metal compound. Transition metals are defined here as metals of group IIIB to group VIIIB, including the "inner transition metals", such as the lanthanides.

Transition metal compounds can be used in the form of salts, such as chlorides, as oxides, as coordination complexes, such as carboxylates and beta-diketonates, as organometallic complexes and the like. Preferably, carboxylates are used as demonstrated below in Table 1.

The transition metal compounds can react with the low-melting impurities, for example, from the alkaline papers so that the impurities are broken down. One class of compounds representative of these low-melting compounds is the dialkyl ketones. One example of a dialkyl ketone is distearyl ketone. Although the breakdown mechanism of such dialkyl ketones under the influence of the transition metal compounds is not completely clear, it is speculated, on the basis of experiments, that oxidation may play a part in the breakdown. For the breakdown of such dialkyl ketones it has in practice been found favorable to use a transition metal compound in which the transition metal has a reduction potential of more than 0.7. Reduction potentials of this kind are given, inter alia, in the "Handbook of Chemistry and Physics", 57th Edition, 1976, published by the CRC Press, Cleveland, Ohio, page D141 et seq.

Suitable transition metal compounds are the transition metal compounds in which the transition metal is selected from group VIIB and group VIIIB, such as Mn, Co, Fe, Pt. The breakdown of the low-melting compounds with these compounds is reasonably good. Manganese compounds have preference, because of their high activity even when mixed in a rubber matrix. Examples of manganese compounds with very good breakdown properties are manganese octoate, manganese cyclohexylbutyrate, manganese stearate and manganese acetylacetonate.

The materials which break down impurities can be used in various ways. In a first embodiment, the transition metal compound is mixed in the top layer of the intermediate medium. As a result, it is possible locally to break down the impurities deposited on the top layer.

In a second embodiment, the transition metal compound is mixed in an intermediate layer disposed beneath the top layer. An advantage of this is that the top layer properties necessary for the toner transfer are not affected by the admixture of a breakdown material in the top layer. A rubber material is advantageously selected for the intermediate layer. A silicone rubber layer has proved particularly suitable. In this way, it is possible during stand-by and run periods to continuously discharge impurities from the top layer to the intermediate layer so that the useful life of the intermediate medium and the period of use of the image-forming medium are greatly increased.

A third embodiment is characterized in that the transition metal compound is preferably mixed in a rubber material for application to a cleaning means which can be brought into contact with the top layer of the intermediate medium between the second and first transfer zones.

RTV or HTV silicone rubbers, inter alia, are used as the top layer for the intermediate media. They are obtained by curing to an elastomeric composition polyorganosiloxane mixtures bearing reactive groups, under the influence of a suitable catalyst and at room temperature or at elevated temperature. The top layer can also contain additives to improve its properties, such as mechanical strength, thermal conductivity and antistatic behavior. Typical rubber compositions for forming a top layer for intermediate media usable as a temporary support for a powder image are described in UK patent No. 1 279 687 and Example 1 of European patent application number 146 980.

The intermediate medium can be constructed as a cylindrical metal roller provided with an elastic rubber intermediate layer to which a top layer is applied.

Another embodiment is characterized in that the intermediate medium is constructed as an endless belt which is trained around two or more shafts, the support being in the form of a layer of material which breaks down impurities. A fiber-reinforced belt of this kind can also be brought into contact adjacent its inside with a cleaning means, such as, for example, a rubber-covered roller provided with a material which breaks down impurities. The shafts can also be covered with a rubber material of this kind. An intermediate medium belt of this kind is simple and economic to manufacture and easily replaced at the end of its life. Another embodiment is characterized in that the support is constructed as a fabric belt, the fabric belt being provided with a layer of material which breaks down impurities, to which a top layer is applied. Silicone rubber, for example, is suitable for the rubber material in the intermediate layer.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DISCUSSION

Figure 1:
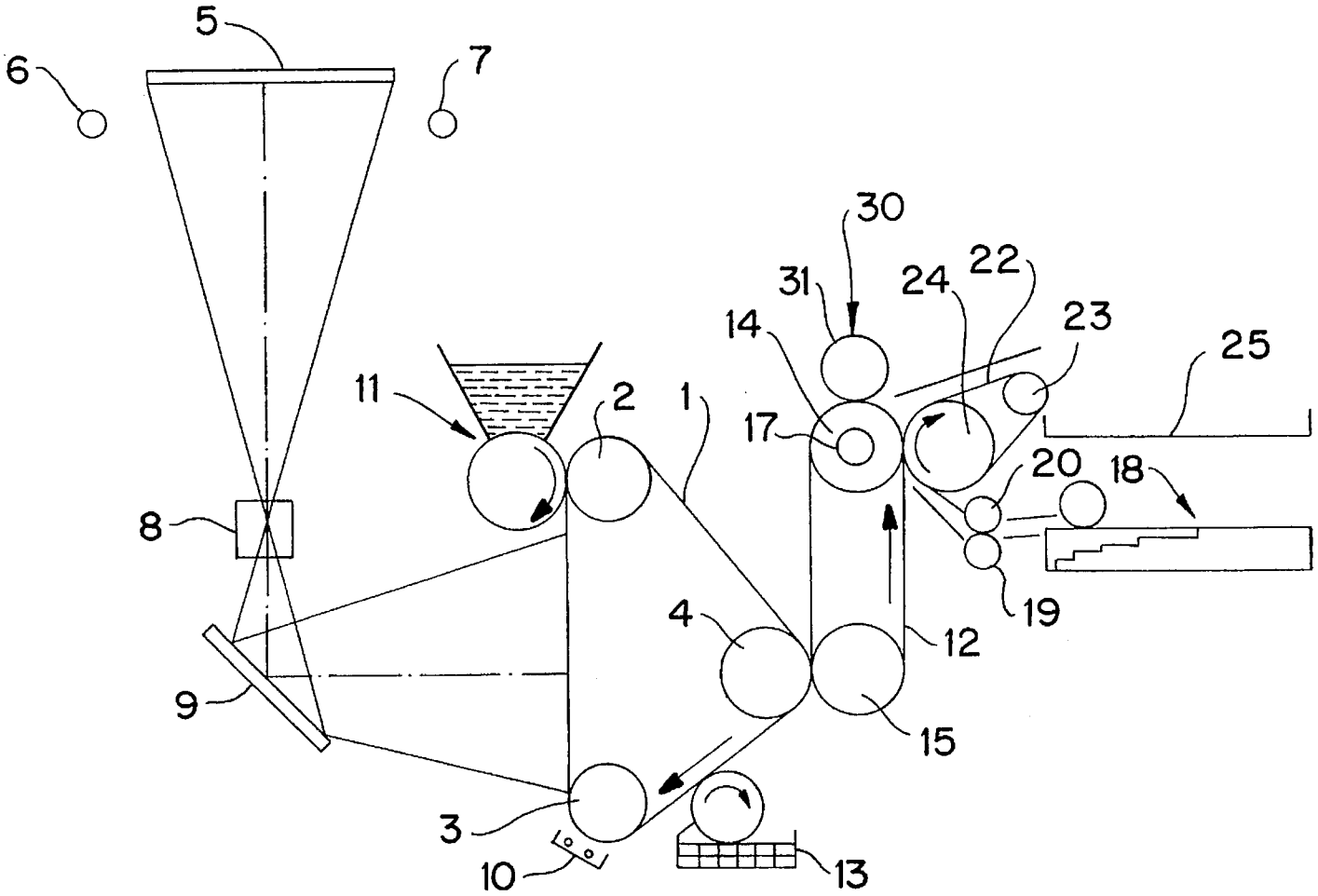
FIG. 1 is a diagrammatic cross-section of one embodiment of the device according to the present invention.

The image-forming device shown in FIG. 1 is provided with an endless photoconductive belt 1 which is advanced at a uniform speed by means of drive and guide rollers 2, 3 and 4 respectively. The image of an original on a window 5 is projected on to the belt 1 by means of flashlights 6 and 7, a lens 8 and a mirror 9, after the belt has been electrostatically charged by a corona device 10. The latent charge image formed on the belt 1 after the flash exposure is developed with toner powder by a magnetic brush device 11 to give a toner image which is then brought into contact under pressure with an endless intermediate medium belt 12 movable in a transport direction in a first transfer zone, the belt 12 being provided with a top layer of soft elastic and heat-resistant material, e.g. silicone rubber. The toner image in this case is transferred to the belt 12 from the belt 1 by adhesion forces. After this image transfer, any remaining image residues are removed from belt 1 by means of a cleaning device 13, whereafter the photoconductive belt 1 is ready for reuse.

The intermediate medium belt 12 is trained over drive and guide rollers 14 and 15, and is heated to a temperature above the toner powder softening temperature, e.g. by an infrared heater 17 disposed inside roller 14. While belt 12 with the toner image thereon is advanced, the toner image becomes tacky as a result of the heating. In a second transfer zone the tacky toner image is then transferred, under the influence of pressure in the second transfer zone, by means of a pressure member in the form of a belt 22 trained over rollers 23 and 24, and is at the same time fixed on a sheet of receiving material supplied from reservoir 18 via rollers 19 and 20. To ensure a better grip on the belt in the second transfer zone, the outer side of roller 14 can be advantageously provided with small teeth or other protruding projections which grip into the backside of the intermediate belt 12 to control the rubber flow and consequently the print quality in the second transfer zone. Finally, the copy obtained in this way is deposited in collecting tray 25 by belt 22, which is trained over rollers 23 and 24.

Figure 3:
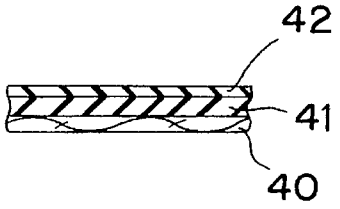
FIG. 3 is a diagrammatic cross-section showing the layer structure of one embodiment of an intermediate belt usable in an apparatus according to the invention.
Figure 2:
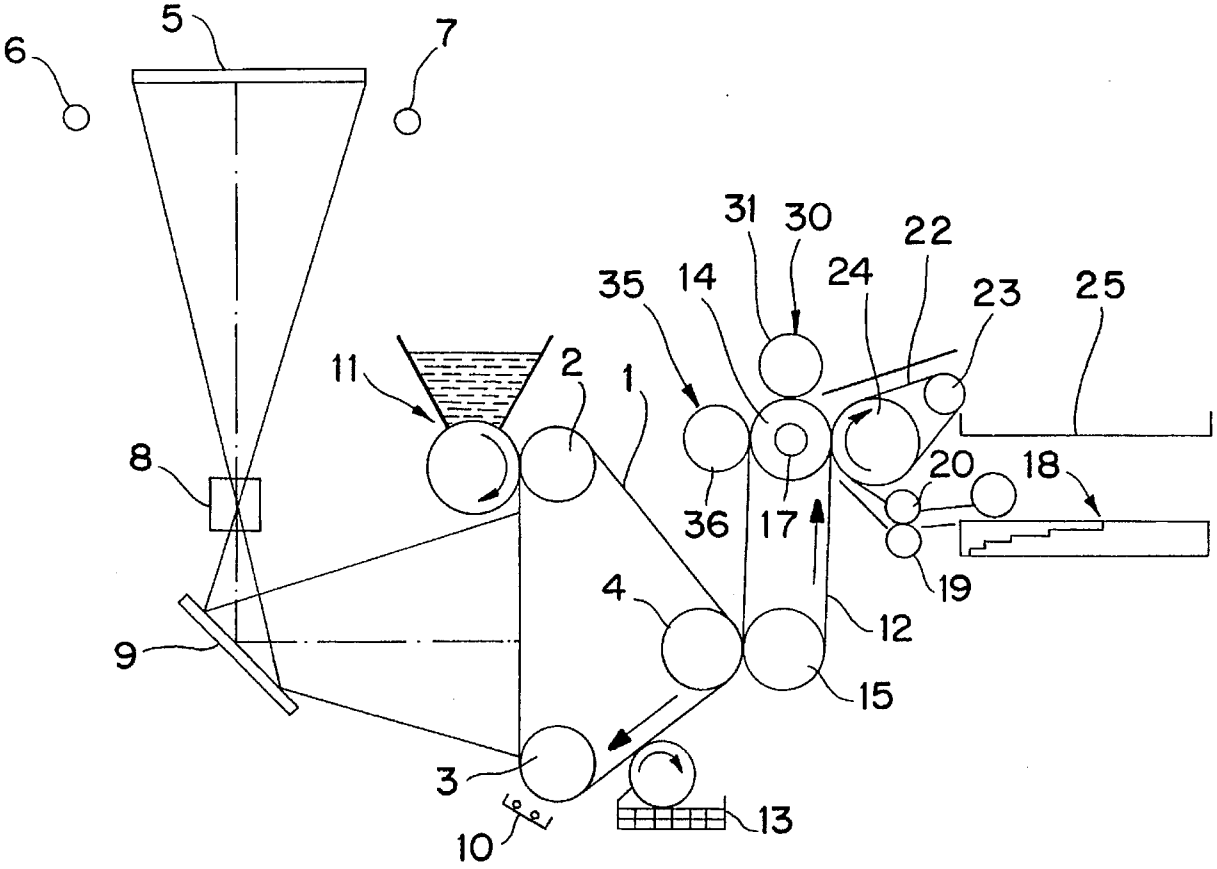
FIG. 2 is a diagrammatic cross-section of another embodiment of the device according to the invention.

The intermediate medium belt 12 shown in FIG. 2 is constructed, as seen in FIG. 3, as a polyester fabric belt 40 provided with a 2 mm thick layer of peroxide-hardened silicone rubber 41, in which 1% by weight of manganese octoate has been mixed. A 60 μm thick top layer 42 is applied to this layer consisting of a non-pigmented RTV silicone rubber obtained by cross-linking an α-ω-hydroxy-polydimethylsiloxane with a tetra-ethyl silicate under the influence of dibutyl tin dilaurate. A cleaning means 30 is also provided for toner residues in accordance with U.S. Pat. No. 4,607,947, and its surface 31 can be brought into contact with the intermediate medium.

In another embodiment the top layer of the intermediate medium can be provided with 1% by weight of manganese octoate. In one embodiment in which the top layer is provided with a transition metal compound, the above-described intermediate layer may also be provided with a transition metal compound.

A third embodiment of the device according to the present invention is shown in FIG. 2. Like references refer to the same parts as in FIG. 1. In order to remove impurities from the intermediate medium belt 12, the device is provided with a cleaning means 35, e.g. in the form of a freely rotatable roller 36 provided with a layer of peroxide-hardened silicone rubber, in which 0.5% of a transition metal compound, such as manganese stearate, has been mixed. Other impurity-absorbing rubbers may be used as stated in U.S. Ser. No. 093,657, filed Jul. 20, 1993, in combination with a transition metal compound. Furthermore, an impurity-absorbing material such as carbon black may be admixed.

The cleaning means may be used on its own, but it can also be used in combination with an intermediate medium, in which an impurity-breakdown material is mixed in an intermediate layer and/or in the top layer.

Examples of transition metal compounds are given in Table 1 together with the reduction potential of the transition metal. The percentage breakdown is also indicated, determined by bringing 0.02 g of a suitable model compound (distearyl ketone) into contact with 0.05 g of transition metal compound for 24 hours at 100° C. and then measuring the amount of residual distearyl ketone.

TABLE 1

| Transition Metal Compound | Reduction Potential | | % Breakdown |
|---|---|---|---|
| Cobalt octoate | 1.842 | $Co^{3+} \rightarrow Co^{2+}$ | 55 |
| Cerium octoate | 1.61 | $Ce^{4+} \rightarrow Ce^{3+}$ | 96 |
| Manganese stearate | 1.51 | $Mn^{2+} \rightarrow Mn^{+}$ | 96 |
| Manganese acetate | 1.51 | $Mn^{2+} \rightarrow Mn^{+}$ | 73 |
| Manganese acetylacetonate | 1.51 | $Mn^{2+} \rightarrow Mn^{+}$ | 28 |
| Manganese octoate | 1.51 | $Mn^{2+} \rightarrow Mn^{+}$ | 100 |
| Manganese maleinate | 1.51 | $Mn^{2+} \rightarrow Mn^{+}$ | 91 |
| Manganese (IV) dioxide | 1.51 | $Mn^{2+} \rightarrow Mn^{+}$ | 63 |
| Manganese chloride | 1.51 | $Mn^{2+} \rightarrow Mn^{+}$ | 96 |
| Pt on activated carbon | 1.2 | $Pt^{2+} \rightarrow Pt$ | 79 |
| Iron (III) stearate | 0.77 | $Fe^{3+} \rightarrow Fe^{2+}$ | 30 |
| Copper phthalocyanine | 0.16 | $Cu^{2+} \rightarrow Cu^{+}$ | 0 |
| Chromium acetylacetonate | −0.41 | $Cr^{3+} \rightarrow Cr^{2+}$ | 0 |

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A device for transferring a toner image from an image-forming medium to a receiving material comprising:

an image forming medium for supporting a toner image, an endless movable intermediate medium movable in a transport direction having a support provided with a top layer secured via its rear surface to said support, said intermediate medium being in contact with said image-forming medium in a first transfer zone, heating means for heating said toner image on said top layer of said intermediate medium, a biasing means which in a second transfer zone can be brought into contact with said intermediate medium so as to transfer said toner image to said receiving material, transport means for transporting said receiving material through said second transfer zone, and means for breaking down impurities transferred by said receiving material to said top layer of said intermediate medium.

2. A device according to claim 1, wherein said means for breaking down impurities on said intermediate medium comprises a material which breaks down impurities when brought into contact with said impurities, said material containing a transition metal compound.

3. A device according to claim 2, wherein the transition metal of said transition metal compound has a reduction potential greater than 0.5.

4. A device according to claims 2 or 3, wherein said transition metal compound contains a transition metal selected from at least one of group VIIB or group VIIIB.

5. A device according to claim 4, wherein said transition metal compound contains manganese.

6. A device according to claim 5, wherein said transition metal compound is selected from at least one member of the group consisting of manganese octoate, manganese cyclohexylbutyrate, manganese stearate, and manganese acetylacetonate.

7. A device according to claim 2, wherein said transition metal compound contains one or more carboxylate ligands.

8. A device according to claim 6, wherein said transition metal compound contains one or more carboxylate ligands.

9. A device according to claim 2, wherein said transition metal compound is mixed in said top layer.

10. A device according to claim 9, wherein at least 0.5% by weight of said transition metal compound is mixed in said top layer.

11. A device according to claim 2, further including an intermediate layer beneath said top layer wherein said transition metal compound is mixed in said intermediate layer disposed beneath said top layer.

12. A device according to claim 11, wherein said intermediate layer comprises a rubber material.

13. A device according to claim 12, wherein said rubber material comprises silicone rubber.

14. A device according to claims 12 or 13, wherein at least 0.5% by weight of said transition metal compound is mixed in said rubber material.

15. A device according to claim 2, further including a cleaning means which can be brought into contact with the top layer of the intermediate medium between the second and first transfer zones wherein said transition metal compound is disposed on said cleaning means.

16. A device according to claim 15, wherein said transition metal compound is mixed in a rubber material.

17. A device according to claim 16, wherein at least 0.5% by weight of said transition metal compound is mixed in the rubber material.

18. A method for removing residual impurities from the top surface layer of an intermediate medium of an imaging system comprising:

(a) developing a toner image on a surface of an image recording medium;

(b) transferring said toner image to a top layer of an endless, movable intermediate medium movable in a transport direction in a first transfer zone;

(c) transferring said toner image from said top layer of said intermediate medium in a second transfer zone to an image receiving material, and (d) contacting said top layer of said intermediate medium with a material for breaking down residual impurities on said intermediate medium when brought into contact with said impurities, said material containing a transition metal compound.

19. A method according to claim 18, wherein the transition metal of said transition metal compound has a reduction potential greater than 0.5

20. A method according to claims 18 or 19, wherein said transition metal compound contains a transition metal selected from am least one of group VIIB or group VIIIB.

21. A method according to claim 20, wherein said transition metal compound contains manganese.

22. A method according to claim 21, wherein said transition metal compound is selected from at least one member of the group consisting of manganese octoate, manganese cyclohexylbutyrate, manganese stearate, and manganese acetylacetonate.

23. A method according to claim 18, wherein said transition metal compound contains one or more carboxylate ligands.

24. A method according to claim 21, wherein said transition metal compound contains one or more carboxylate ligands.

25. A method according to claim 18, wherein said transition metal compound is mixed in said top layer.

26. A method according to claim 25, wherein at least 0.5% by weight of said transition metal compound is mixed in said top layer.

27. A method according to claim 26, further including an intermediate layer beneath said top layer wherein said transition metal compound is mixed in said intermediate layer disposed beneath said top layer.

28. A method according to claim 27, wherein said intermediate layer comprises a rubber material.

29. A method according to claim 28, wherein said rubber material comprises silicone rubber.

30. A method according to claims 28 or 29, wherein at least 0.5% by weight of said transition metal compound is mixed in said rubber material.

* * * * *